US005782736A

United States Patent [19]

Brizzi et al.

[11] Patent Number: 5,782,736

[45] Date of Patent: Jul. 21, 1998

[54] METHOD AND DEVICE FOR SUPPLYING COLLAR-COUPON ASSEMBLIES TO THE WRAPPING LINE OF A PACKING MACHINE FOR PRODUCING RIGID HINGED-LID PACKETS

[75] Inventors: Marco Brizzi, Predosa; Lorenzo Cocchi; Antonio Gamberini, both of Bologna, all of Italy

[73] Assignee: G.D Societa' Per Azioni, Bologna, Italy

[21] Appl. No.: 494,705

[22] Filed: Jun. 26, 1995

[30] Foreign Application Priority Data

Jun. 27, 1994 [IT] Italy ..... BO94A0293

[51] Int. Cl.[6] ..... B65H 37/04; B31B 1/90

[52] U.S. Cl. ..... 493/392; 493/84; 493/351

[58] Field of Search ..... 493/84, 350, 351, 493/390, 392, 344, 379, 384; 29/525, 771, 773; 156/256, 263, 285, 293, 423, 556

[56] References Cited

U.S. PATENT DOCUMENTS

| | | | |
|---|---|---|---|
| 3,048,088 | 8/1962 | Fischer | 493/344 |
| 3,416,414 | 12/1968 | Smithe | 493/344 |
| 5,069,658 | 12/1991 | Dupuy | 493/84 |
| 5,163,268 | 11/1992 | Vaccari et al. | 53/397 |

*Primary Examiner*—Jack W. Lavinder

*Attorney, Agent, or Firm*—Marshall, O'Toole, Gerstein, Murray & Borun

[57] ABSTRACT

A method and device for supplying collar-coupon assemblies to the wrapping line of a packing machine for producing rigid hinged-lid packets, whereby a collar and a respective coupon, as they travel along respective paths to a mating station, are respectively provided, by cutting, with a pocket, and with an appendix which is inserted at least partly inside the respective pocket at the mating station to make the collar and coupon substantially integral with each other as they travel along a common path extending downstream from the mating station.

10 Claims, 4 Drawing Sheets

METHOD AND DEVICE FOR SUPPLYING COLLAR-COUPON ASSEMBLIES TO THE WRAPPING LINE OF A PACKING MACHINE FOR PRODUCING RIGID HINGED-LID PACKETS

BACKGROUND OF THE INVENTION

The present invention relates to a method of supplying collar-coupon assemblies to the wrapping line of a packing machine for producing rigid hinged-lid packets.

Packing machines for producing hinged-lid packets of cigarettes are known to feature a collar and coupon supply device associated with a wrapping wheel presenting a number of seats, each for housing a group of cigarettes wrapped in foil, and for also retaining the collar contacting the respective group.

The supply device, as described and illustrated for example in U.S. Pat. No. 5,163,268, comprises a supply wheel with suction seats for successively receiving respective collars and feeding them through a mating station where each is mated with a respective coupon.

On the supply wheel, each coupon is maintained in a precise position in relation to the respective collar by further suction seats fitted to the supply wheel itself, and is fed by the supply wheel, together with the respective collar, to a transfer station where the collar and coupon are transferred to the wrapping wheel and on to the bottom outer surface of the foil wrapping of a respective group of cigarettes.

On the above known supply device, the precise mutual position of each collar and respective coupon is maintained solely by external retaining means consisting of the suction seats on the supply wheel, and which are deactivated as the collar-coupon assembly is transferred to the wrapping wheel. During transfer, therefore, the collar and respective coupon may possibly shift in relation to each other, thus resulting later in rejection of the respective group of cigarettes by the packing machine.

SUMMARY OF THE INVENTION

It is an object of the present invention to provide a method of supplying collar-coupon assemblies, designed to overcome the aforementioned drawback.

According to the present invention, there is provided a method of supplying collar-coupon assemblies to a wrapping line for producing rigid hinged-lid packets; the method comprising the steps of feeding a succession of collars and a succession of coupons along a first and second path respectively and substantially in time with each other to a mating station where a succession of said collar-coupon assemblies is formed; securing the collar and coupon in each assembly in relation to each other via external retaining means; and feeding said succession of assemblies along a third path to a transfer station where the assemblies are transferred to said wrapping line; the method being characterized in that it also comprises a direct connecting step wherein each collar and respective coupon are connected directly to each other and substantially independently of said external retaining means.

According to a preferred embodiment of the above method, said direct connecting step comprises the steps of respectively providing each collar and each coupon with first and second mutual engaging means; and connecting said engaging means to each other upstream from said transfer station, so as to at least partly secure each collar and respective coupon in position in relation to each other.

The present invention also relates to a device for supplying collar-coupon assemblies to a wrapping line for producing rigid hinged-lid packets.

According to the present invention, there is provided a device for supplying collar-coupon assemblies to a wrapping line for producing rigid hinged-lid packets, the device comprising a first and second supply line for feeding a succession of collars and a succession of coupons in time with each other and along respective first and second paths converging with each other; a mating station located at the intersection of said two paths, for forming a succession of said collar-coupon assemblies; a transfer station for transferring said assemblies to said wrapping line; a conveyor extending through said mating and transfer stations, and defining a third path for said assemblies; and external retaining means fitted to said conveyor and for maintaining the collar and coupon in each assembly in a fixed position in relation to each other along at least part of said third path; the device being characterized in that it also comprises first and second cutting means located respectively along said first and said second supply line, and which provide for forming, on each collar and each coupon, first and respectively second mutual engaging means which are connected at least partly to each other along said third path.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
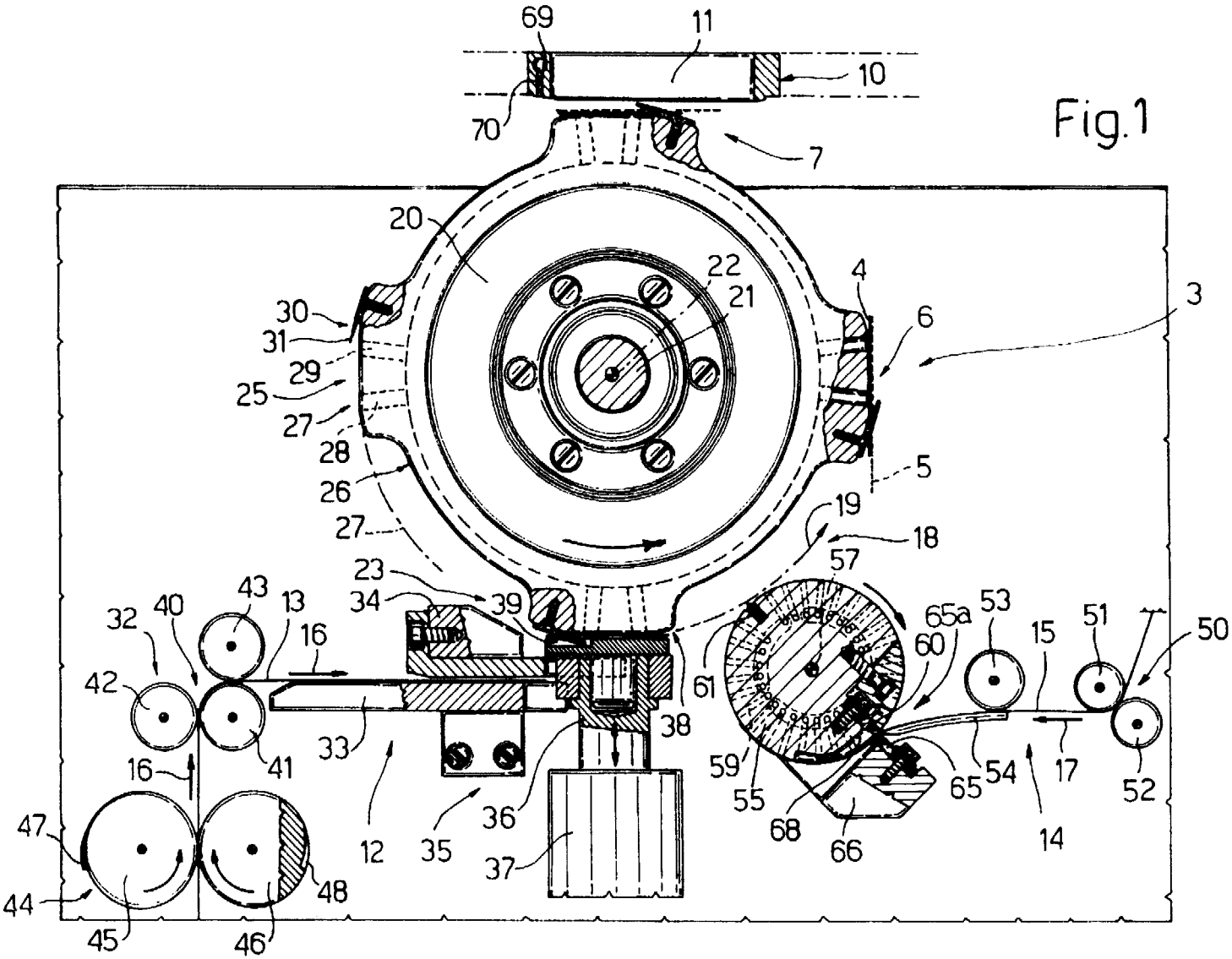
FIG. 1 shows a partially sectioned front view, with parts removed for clarity, of a preferred embodiment of the collar-coupon assembly supply device according to the present invention.
Figure 2:
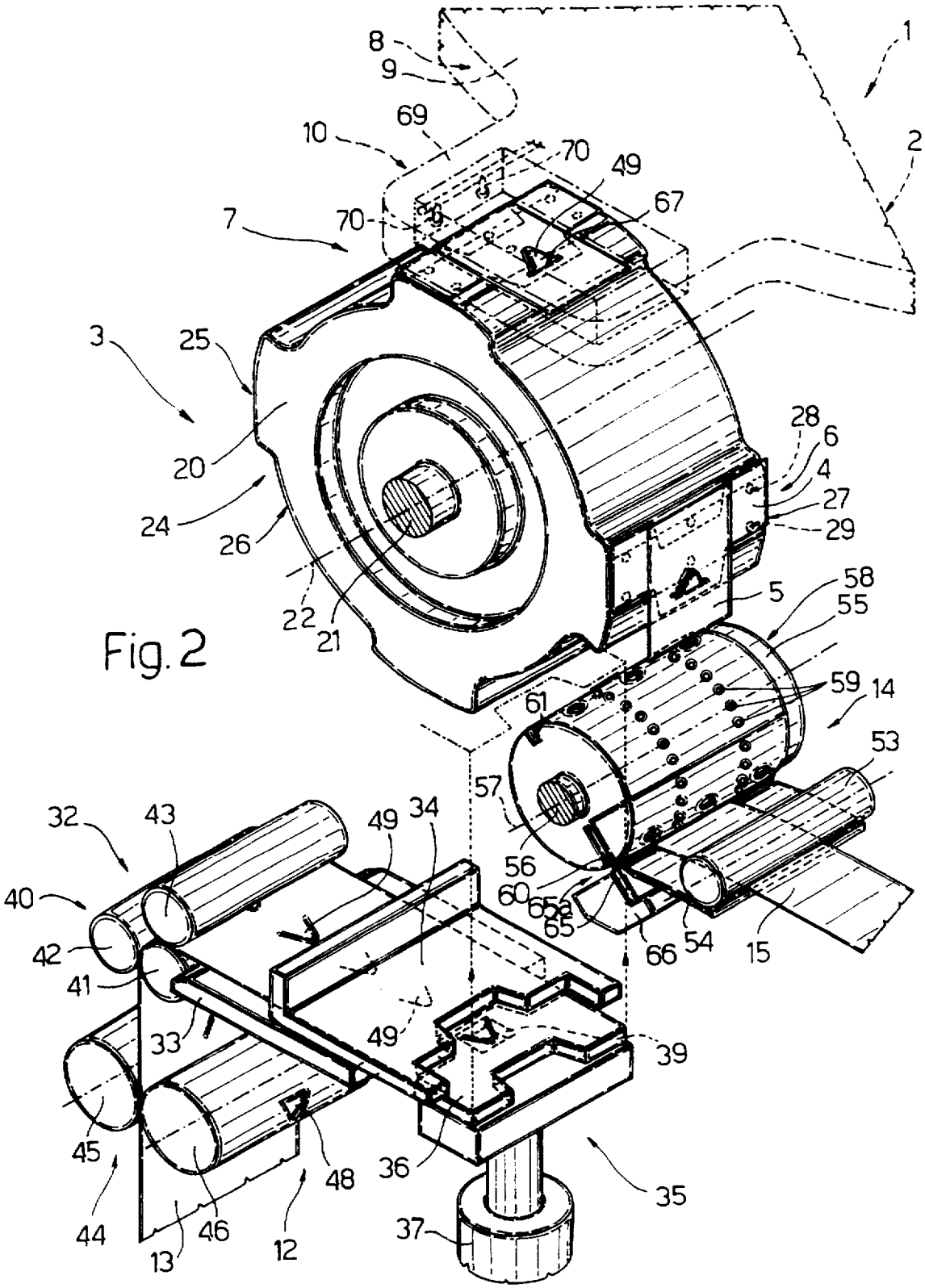
FIG. 2 shows a view in perspective of the FIG. 1 device.

With particular reference to FIGS. 1 and 2, number 1 indicates a cigarette packing machine comprising a wrapping line 2 for producing rigid hinged-lid packets (not shown), and a device 3 for supplying wrapping line 2 with a succession of collars 4. Each collar 4 is paired with a respective coupon 5 to form a succession of collar-coupon assemblies 6 which are fed by device 3 to a transfer station 7 where they are transferred to a wheel 8 forming part of line 2. Wheel 8 comprises a disk 9 rotating about a substantially vertical axis (not shown) and presenting a number of peripheral frames 10, each for receiving a respective group of cigarettes enclosed in a foil wrapping 11.

As shown in FIG. 1, device 3 is located beneath wheel 8 so as to cooperate with it at station 7, and comprises a first line 12 for supplying a continuous strip 13 of cardboard or similar, which is cut into a succession of collars 4; and a second line 14 for supplying a continuous strip 15 of paper or similar, which is cut into a succession of coupons 5. Lines 12 and 14 define respective separate paths 16 and 17 for collars 4 and coupons 5 respectively; and paths 16 and 17 come together at a mating station 18, as of which they define a single path 19 extending through transfer station 7.

Common path 19 is defined by a supply wheel 20 fitted to a drive shaft 21 so as to rotate anticlockwise (in FIG. 1) in steps about a horizontal axis 22 perpendicular to the FIG. 1 plane; and lines 14 and 12 are respectively tangent to wheel 20 at mating station 18, and at a loading station 23 upstream from station 18 in the rotation direction of wheel 20.

Wheel 20 is defined externally by a cylindrical surface 24 divided into axial segments 25 by a number of axial grooves 26; and, as shown in FIG. 1, as wheel 20 is rotated, each segment 25 travels along a circular path 27 extending through loading station 23, mating station 18, and transfer station 7. Each segment 25 presents two sets of three radial holes 28 and 29 communicating in known manner with a known suction system (not shown); and a substantially wedge-shaped tab 30 fitted to and tangent to segment 25, so as to project outwards at its free end 31 located frontwards in the rotation direction of wheel 20.

With reference to FIGS. 1 and 2, line 12 comprises a unit 32 for feeding strip 13 along path 16, the end portion of which extends between a plate 33 substantially tangent to wheel 20 at loading station 23, and a fixed shaped blade 34 integral with plate 33 and hereinafter referred to as a "counterblade". Counterblade 34 forms part of a known cutting device 35 also comprising a blade 36, which, by means of an actuator 37 operated in time with wheel 20, is moved to and from counterblade 34 in a substantially radial direction in relation to wheel 20, so as to successively cut portions corresponding to respective collars 4 off the end of strip 13 fed along plate 33 by unit 32. Once cut off strip 13, each collar 4 is transferred by blade 36 to a respective suction seat 38 located at loading station 23 and defined, on wheel 20, by a respective segment 25 and respective suction holes 28 and 29. As shown in FIG. 1, the front surface of blade 36 presents a cavity 39 defining a seat for successively receiving tabs 30.

As shown in FIG. 1, unit 32 comprises a traction and push assembly 40 defined by a drive roller 41, and by two pressure rollers 42 and 43 for gripping strip 13 against the periphery of roller 41 and feeding it in steps to cutting device 35; and a cutting assembly 44 located upstream from assembly 40 in the traveling direction of strip 13, and in turn comprising two counter-rotating rollers 45 and 46 parallel to rollers 41–43 and to wheel 20, located on either side of strip 13, and respectively presenting a radial cutting appendix 47, and a radial cavity 48 for receiving appendix 47 and of a shape corresponding to a negative no smaller than appendix 47. More specifically, appendix 47, when viewed from above, is substantially triangular with its apex facing frontwards in the rotation direction of the outer periphery of roller 45, and, in section, is substantially in the form of a spiral connected at the rear to the outer surface of roller 45. Rollers 45 and 46 each present a circumference of the same length as collar 4, and are so connected in known manner (not shown) as to rotate in time with each other and at the same surface speed as roller 41, and to cut on strip 13 a succession of slits, each defining a substantially triangular appendix or tab 49 with its base integral with and located rearwards in the traveling direction of strip 13, and its apex facing frontwards in the traveling direction of strip 13.

Line 14 comprises a traction and push assembly 50 defined by a drive roller 51 and pressure roller 52 located on either side of strip 15 for feeding it at constant speed along path 17, and by a pressure roller 53 for maintaining strip 15 contacting a guide plate 54 extending along path 17. Line 14 also comprises a supply and cutting roller 55 fitted to a drive shaft 56 (FIG. 2) so as to rotate clockwise (in FIG. 1) about an axis 57 parallel to axis 22, and at a substantially constant surface speed over twice that of roller 51 and corresponding to such an angular speed that roller 55 makes one full turn about axis 57 in the time taken by roller 51 to supply a portion of strip 15 equal in length to that of coupon 5.

Figure 3:
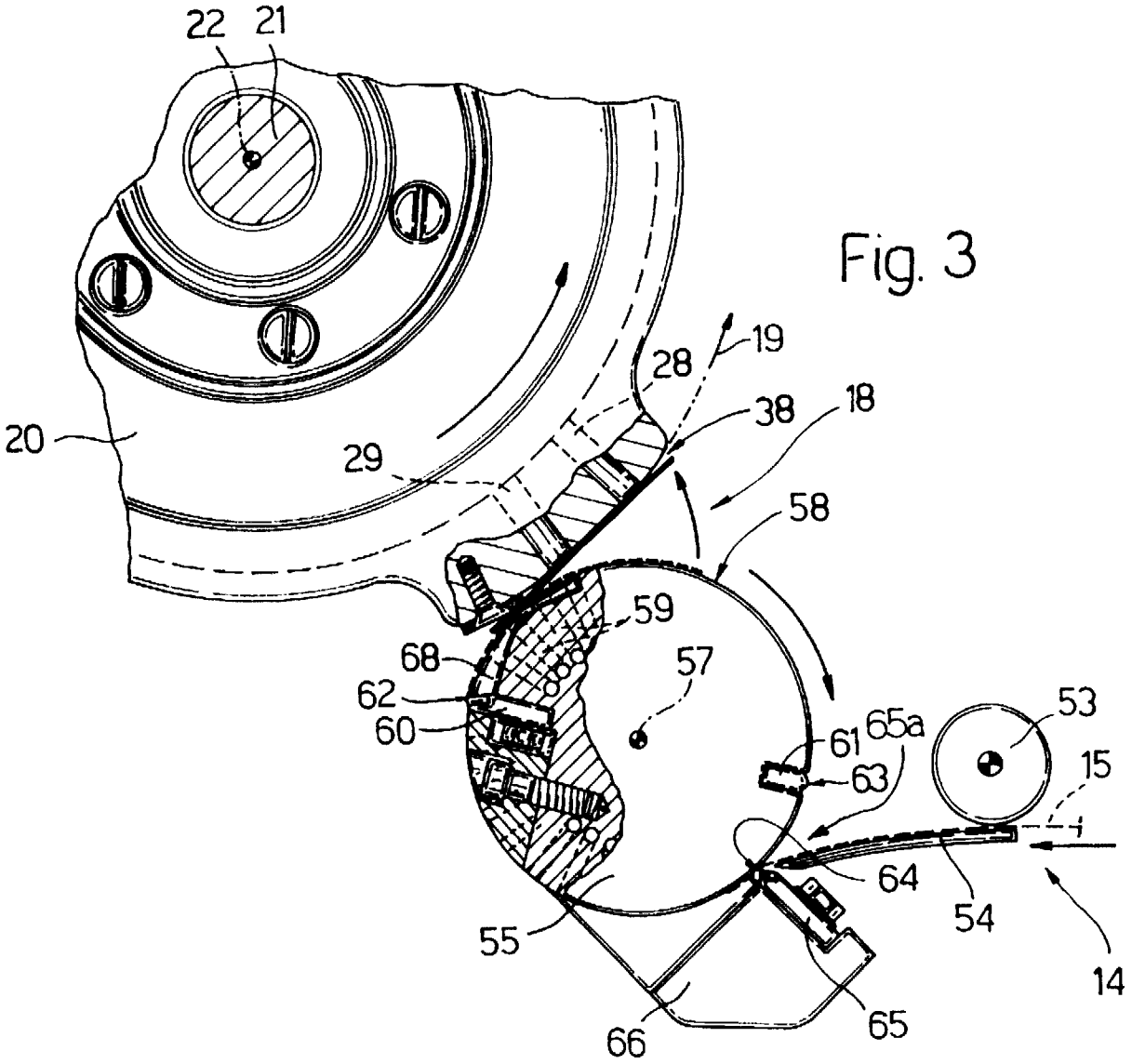
FIG. 3 shows a partial, partially sectioned, larger-scale view, with parts removed for clarity, of the FIG. 1 device in a given operating position.
Figure 5:
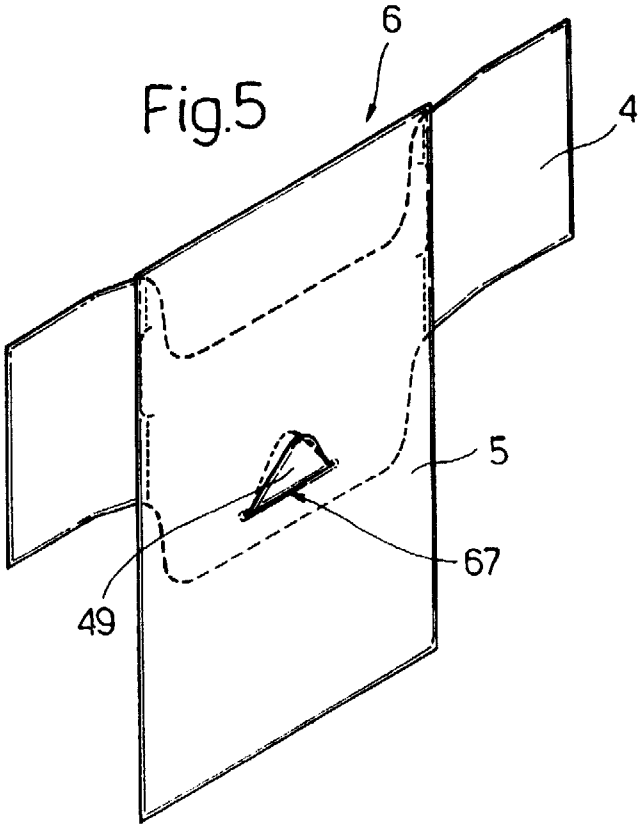
FIGS. 4 and 5 show schematic views in perspective of two FIG. 1 details in two different operating positions.
Figure 4:
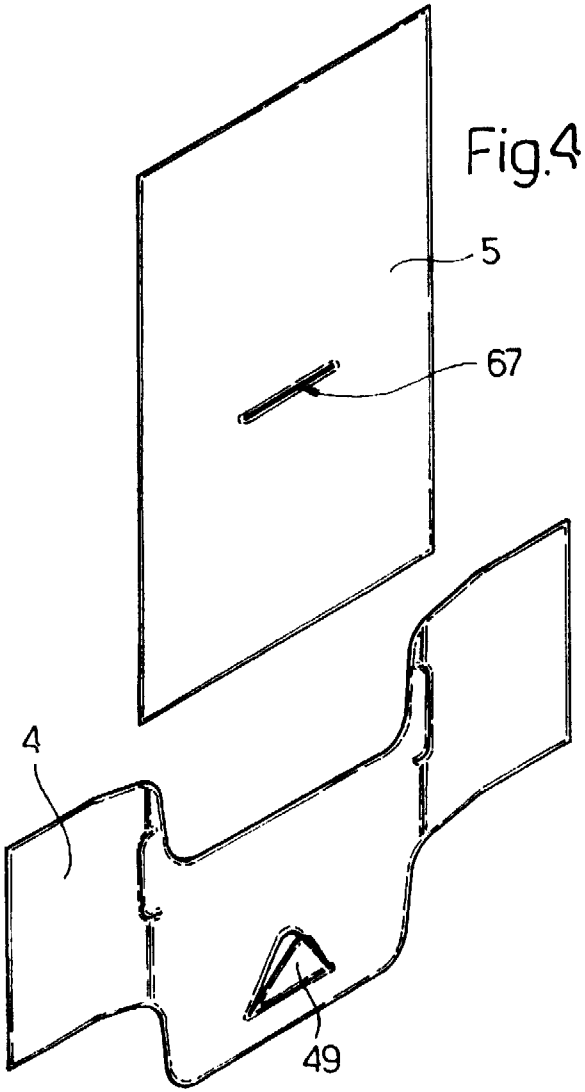

Roller 55 is defined externally by a substantially cylindrical surface 58 tangent to path 19 at station 18, and presenting a circumference over twice as long as coupon 5. Surface 58 is a suction surface presenting a number of suction holes 59 communicating in known manner (not shown) with a suction source (not shown), and is divided into two equal portions by two diametrically opposed blades 60 and 61 presenting respective cutting edges 62 and 63 projecting slightly outwards of surface 58 and cooperating, at each turn of roller 55, with the cutting edge 64 of a fixed blade 65 fitted to a bracket 66 and located at a cutting station 65a, adjacent to the output edge of plate 54 (FIG. 3). More specifically, edges 62 and 64 extend over the full width of strip 15, whereas edge 63 extends over the central portion of strip 15 so as to form, in strip 15 and by cooperating with edge 64 of blade 65, a transverse slit or pocket 67 at least as long as the maximum width of appendix 49.

Finally, adjacent to and to the front of blade 60 in the rotation direction of roller 55, surface 58 presents a cavity 68 defining a seat for successively receiving tabs 30.

In actual use, strip 13, already provided with the succession of appendixes 49 formed by cutting assembly 44, is fed by drive roller 41 of assembly 40 in steps along path 16 to loading station 23 where blade 36 is raised to contact fixed counterblade 34 and so cut off the end of strip 13 a collar 4 presenting a respective appendix 49 at cavity 39. At the same time, wheel 20 is fed forward one step to position a seat 38 in loading station 23 and directly over blade 36 which, continuing to travel upwards past counterblade 34, feeds the detached collar 4 on to seat 38 where it is retained by suction through holes 29 and some of holes 28. More specifically, and as shown in FIG. 1, as each collar 4 is transferred on to respective seat 38, tab 30 is inserted inside cavity 39 and appendix 49 is raised outwards in relation to the rest of collar 4.

At this point, blade 36 is lowered and wheel 20 fed forward one step to feed seat 38 and collar 4 through station 18 to mate collar 4 with a respective coupon 5. As shown in FIGS. 1 and 2, the operating step of wheel 20 is longer than the distance between loading station 23 and mating station 18, and each collar 4 is fed continuously and at increasing speed towards station 18. More specifically, the traveling speed of collar 4 presents a value V1 at station 18, reaches a maximum value V2 immediately downstream from station 18, and then decreases until it eventually reaches zero speed at the next stop.

With reference to FIGS. 1 and 3, an end portion of strip 15 is fed forward by roller 51 at a speed VA past fixed blade 65, into a position tangent to surface 58, and into engagement with suction holes 59; and since, as already stated, the surface speed of roller 55 is at least twice speed VA, the portion of strip 15 gradually projecting beyond fixed blade 65 adheres to and slides along surface 58 with no change in its traveling speed. As such, blade 60, initially contacting the end of strip 15 at fixed blade 65, moves away from the end of the strip, while blade 61 moves up to fixed blade 65 to form pocket 67 when a given portion of strip 15 shorter than coupon 5 (in particular, substantially equal to half the length of coupon 5) projects beyond fixed blade 65. At this point, blade 61 travels along and past the free end of strip 15, while blade 60 moves back up to fixed blade 65 to cut the whole of strip 15 and so form a coupon 5 which, no longer retained by traction assembly 50, is fed to station 18 at the surface speed of roller 55. In this connection, it should be pointed out that the surface speed of roller 55 is constant and substantially equal to the speed V1 at which collar 4 travels through station 18; and line 14 and wheel 20 are so timed in relation to each other as to simultaneously supply station 18 with a collar 4 and coupon 5, so that the pocket 67 of coupon 5 is positioned slightly ahead, in the traveling direction of wheel 20, in relation to the free end of appendix 49 held up by tab 30.

As the suction through holes 59 is cut off in known manner at station 18, coupon 5 is gradually released by wheel 55, and its front end is retained contacting seat 38 by suction through one of holes 28. However, since the rear portion of coupon 5 initially continues to adhere to roller 55, coupon 5 continues traveling at speed V1, whereas seat 38 accelerates up to its maximum speed V2, so that coupon 5 slides partially along seat 38, and appendix 49 is gradually inserted inside pocket 67 before coupon 5 is fully released and carried off by wheel 20.

At the next step of wheel 20, the newly formed collar-coupon assembly 6 is fed along path 19 to station 7 where it is transferred to wheel 8 of wrapping line 2.

In connection with the formation of collar-coupon assemblies 6 as described above, it should be pointed out that, depending on the extent to which each coupon 5 slides along seat 38 and/or on the timing of each coupon 5 in relation to collar 4 at station 18, appendix 49 may be inserted either fully or only partly inside pocket 67. In the latter case, the front end of the coupon therefore projects frontwards in relation to the front end of the collar, so that, when assembly 6 is transferred to wheel 8 with the front end of collar 4 coincident with the front edge—in the rotation direction of wheel 8 of—wrapping 11 housed inside frame 10, a front portion of coupon 5 projects frontwards in relation to wrapping 11, and is positioned beneath the front cross member 69 of frame 10. In which case, coupon 5 may be retained in position in relation to wrapping 11 by means of suction holes 70 formed in cross member 69, but must obviously be backed into its correct position in relation to collar 4 (e.g. by means of a fixed stop element not shown) at a station (not shown) downstream from station 7 along wrapping line 2.

We claim:

1. A method of supplying collar-coupon assemblies to a wrapping line for producing rigid hinged-lid packets; the method comprising the steps of feeding a succession of collars and a succession of coupons along a first and second path respectively and substantially in time with each other to a mating station where a succession of said collar-coupon assemblies is formed; securing the collar and coupon in each assembly in relation to each other via external retaining means; and feeding said succession of assemblies along a third path to a transfer station where the assemblies are transferred to said wrapping line; the method being characterized in that it also comprises a direct connecting step wherein each collar and respective coupon are connected directly to each other, and said direct connecting step including the step of providing respective engaging means for directly connecting each collar and each coupon to each other substantially independently of said external retaining means for enabling said respective collar and coupon to remain directly connected upon release of said external retaining means.

2. A method of supplying collar-coupon assemblies to a wrapping line for producing rigid hinged-lid packets; the method comprising the steps of feeding a succession of collars and a succession of coupons along a first and second path respectively and substantially in time with each other to a mating station where a succession of said collar-coupon assemblies is formed; securing the collar and coupon in each assembly in relation to each other via external retaining means; and feeding said succession of assemblies along a third path to a transfer station where the assemblies are transferred to said wrapping line; a direct connecting step wherein each collar and respective coupon are connected directly to each other and substantially independently of said external retaining means; said direct connecting step comprises the steps of respectively providing each collar and each coupon with first and second mutual engaging means; and connecting said mutual engaging means to each other upstream from said transfer station, so as to at least partly secure each collar and respective coupon in position in relation to each other.

3. A method as claimed in claim 2, characterized in that each collar (4) and each coupon (5) are provided with respective said mutual engaging means (49, 67) upstream from said mating station (18).

4. A method as claimed in claim 2, characterized in that said step of providing each collar (4) and each coupon (5) with respective mutual engaging means (49, 67) comprises the steps of providing each collar (4) and each coupon (5) with a first and second slit respectively; one of said slits defining a pocket (67), and the other defining an appendix (49); and each appendix (49) being inserted at least partly inside the respective said pocket (67) when connecting said mutual engaging means.

5. A method as claimed in claim 2, characterized in that said collars (4) are cut off a continuous strip (13); said first mutual engaging means (49) being formed at regular intervals in said continuous strip (13) before the collars (4) are cut off.

6. A method as claimed in claim 2, characterized in that said coupons (5) are cut off a further continuous strip (15); said second mutual engaging means (67) being formed successively in said further continuous strip (15) before the coupons (5) are cut off.

7. A method as claimed in claim 4, characterized in that each collar (4) is provided with a respective said appendix (49), and each coupon (5) with a respective said pocket (67).

8. A method as claimed in Claim 4, characterized in that the step of directly connecting each said collar (4) and respective coupon (5) comprises the steps of superimposing each coupon (5) on the respective collar (4) with said appendix (49) aligned with said pocket (67) in the traveling direction of the collar (4) and coupon (5) along said third path (19); and moving said collar (4) and said coupon (5) in relation to each other in said traveling direction, so as to at least partly insert said appendix (49) inside said pocket (67).

9. A method as claimed in claim 2, characterized in that said first and second mutual engaging means (49, 67) are only connected partly to each other, so that, along said third path (19), a front portion of each coupon (5) projects frontwards in relation to the front edge of the respective collar (4).

10. A method as claimed in claim 9, characterized in that it comprises the further step of engaging said front portion of said coupon (5) downstream from said transfer station (7) and via further external retaining means (70) on said wrapping line (2).

* * * * *